United States Patent [19]

Jachmann, deceased et al.

[11] Patent Number: 4,664,550

[45] Date of Patent: May 12, 1987

[54] JUNCTION PIECE FOR RELEASABLY CONNECTING ROD-SHAPED ELEMENTS WITH ONE ANOTHER

[76] Inventors: Rolf D. Jachmann, deceased, late of Burgdorf, Fed. Rep. of Germany; by Ursula Jachmann, executrix, vor den Höfen 32, D3167 Burgdorf, Fed. Rep. of Germany

[21] Appl. No.: 709,179

[22] Filed: Mar. 7, 1985

[30] Foreign Application Priority Data

Mar. 17, 1984 [DE] Fed. Rep. of Germany ..... 3409916

[51] Int. Cl.[4] ..... F16B 7/00

[52] U.S. Cl. ..... 403/171; 403/173; 403/287; 403/377

[58] Field of Search ..... 403/377, 171, 264, DIG. 7, 403/172, 287, 375, 174, 176, 178, 173; 52/81

[56] References Cited

U.S. PATENT DOCUMENTS

| | | | |
|---|---|---|---|
| 2,691,538 | 10/1954 | Clausen . | |
| 3,079,188 | 2/1963 | Oswold | 403/377 X |
| 3,347,293 | 10/1967 | Clark | 403/DIG. 7 |
| 3,537,736 | 11/1970 | Kroop | 403/171 |
| 3,632,147 | 1/1972 | Finger . | |
| 3,864,051 | 2/1975 | Reid . | |
| 3,980,408 | 10/1976 | Jachmann . | |
| 3,995,962 | 12/1976 | Mylaeus | 403/171 X |
| 4,017,199 | 4/1977 | Strassle | 403/264 |
| 4,193,706 | 3/1980 | Eberlein et al. | 403/264 X |
| 4,475,841 | 10/1984 | Eberlein | 403/287 |

FOREIGN PATENT DOCUMENTS

| | | | |
|---|---|---|---|
| 901955 | 9/1954 | Fed. Rep. of Germany | 403/171 |
| 1273131 | 4/1961 | France | 403/171 |
| 1489468 | 6/1967 | France . | |
| 539924 | 2/1956 | Italy | 403/171 |
| 334235 | of 1959 | Switzerland . | |
| 676701 | 8/1979 | U.S.S.R. | 403/171 |

*Primary Examiner*—Cornelius J. Husar
*Assistant Examiner*—Joseph A. Fischetti
*Attorney, Agent, or Firm*—Norman S. Blodgett; Gerry A. Blodgett

[57] ABSTRACT

A junction piece for releasably connecting rod-shaped structural elements 7, the junction piece consisting of a junction ball K and a pin element 4 to be radially screwed into the ball K. The pin elements 4 are of cylindrical shape and can be inserted with a cylindrical section into front end recesses of the structural elements 7 and can be fixed axially thereof. In this case, the cylindrical section is made to correspond to an axial guide casing for the pin element 4. The guide casing can be rotated and fixed in the front end recess of the rod-shaped structural elements 7, whereas the pin element 4 is arranged to be prevented from any rotation in the guide casing. It is, however, allowed to be axially displaced against the action of the spring 5.

7 Claims, 2 Drawing Figures

Fig.1
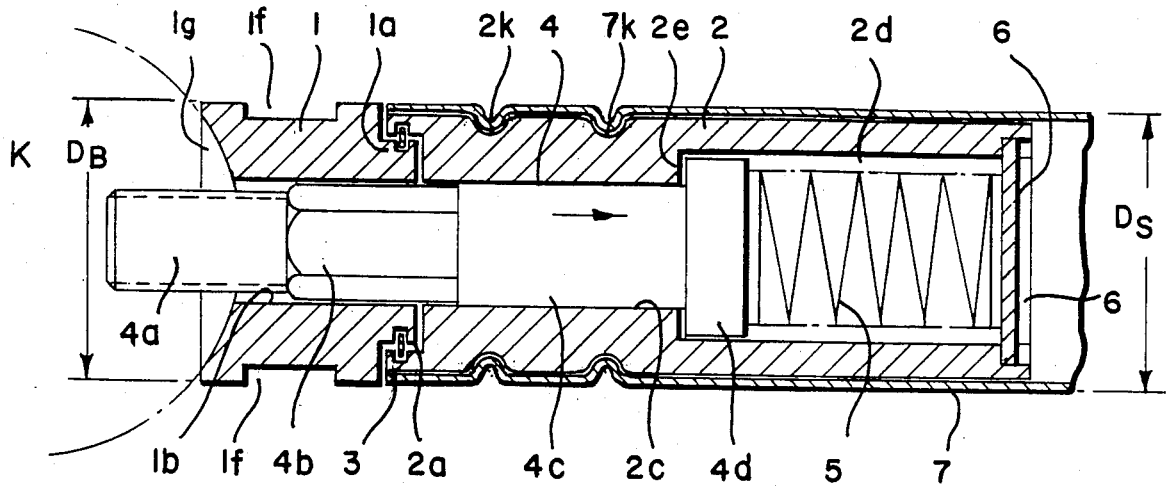
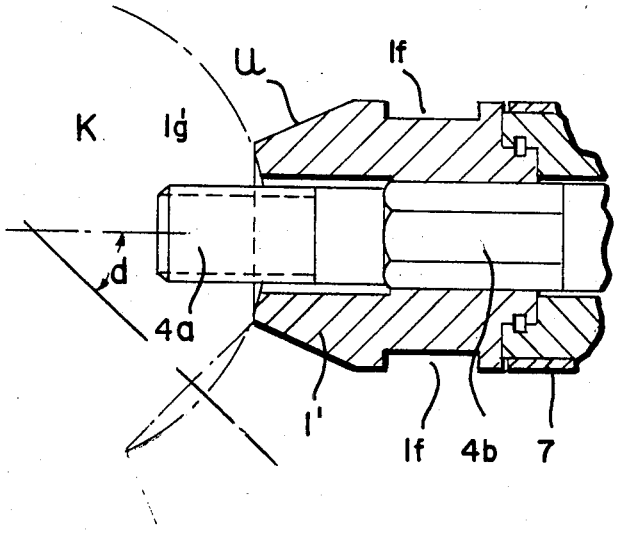
Fig.2

JUNCTION PIECE FOR RELEASABLY CONNECTING ROD-SHAPED ELEMENTS WITH ONE ANOTHER

BACKGROUND OF THE INVENTION

The invention relates to a junction piece for releasably connecting rod-shaped structural elements. The system consists of a junction ball and pin elements which may be radially screwed into the ball, and which are capable of being inserted, via a cylindrical section, into front end recesses provided in the rod-shaped structural elements and axially fixed therein.

Junction pieces of this class (see e.g., DE-OS No. 2420864) serve for forming frames for the assembly of racks, shelves, and tables by means of rod-shaped structural elements and balls. The junction piece assembly formed by the rod-shaped structural elements and balls is required to be tension-proof in the best possible way, but be made releasable for disassembly to be carried out at a later date should new elements have to be added or if such framework structures and shelves have to be assembled and disassembled. Such framework structures should not only allow filling elements to be inserted, but should be made such that, for example, the square opening formed by rod-shaped structural elements and balls would be entirely filled up by means of a convenient rectangular plate. This feature is absolutely necessary for forming framework walls, shelf plates and furniture wall elements. Furthermore, the appearance of the junction piece must visually merge for most of the specified applications, i.e., apart from the rod-shaped structural element and the ball itself no other junction elements should still be visible upon completion of the assembly of the junction piece. The ball should be so arranged on the front end of its respective rod-shaped structural element that the combination of the ball and structural element looks like a monopiece element.

The junction piece of the present invention is of the kind which consists of pin elements having an annular, groove-shaped recess with side walls of truncated conical form. The front end of a fastening screw is screwed into the cylindrical wall of the rod-shaped structural elements and is arranged to be moved against the side wall away from the junction piece. At least at their front ends, the pin elements have screwable pin element projections capable of being screwed into the threaded bores of the junction ball. The combination of the annular groove-like recess, the side walls of truncated conical form, and the fastening screw (which is adapted to be moved against the side wall away from the junction ball and to be screwed into the cylindrical wall) allows the cylindrical wall and the ball to be firmly tightened in an axial direction against one another. Thus, access to the fastening screw from outside as well as easy accessibility even in case of a most sophisticated configuration of the assembled rod-shaped structural element junctions is ensured. The length of the rod-shaped structural elements which are used will not be limited by this type of junction. Furthermore, the axial spacing of the ball from the annular front end of the cylindrical rod will be determined in a true-to-dimension manner through the ball's contact with the annular rim.

As long as the longitudinal axes of the rod-shaped structural elements connected together by means of this known junction piece are rectangular with respect to each other, assembly and disassembly of the frames do not raise any difficulties. However, if frame systems are required to be made, for example, with diagonal junctions, (i.e. junctions in which the longitudinal axes of the rod-shaped structural elements proceed at acute or obtuse angles with respect to each other,) then it will be practically impossible to subsequently insert a rod-shaped structural element into a cubical frame shelf, for example. This is because the positions of the junction balls which are to receive between them the rod-shaped structural elements are confined by the already existing frame construction. The spacing of the balls cannot be increased any more to accommodate the length of the threaded projections of the pin elements for the insertion of a diagonal rod, so that the threaded projections may subsequently be screwed into the threaded bores of the junction balls.

It is the primary object of the invention to create a junction piece accommodating rod-shaped structural elements whose axial length corresponds to the spacing between both junction balls intended to receive between them the rod-shaped structural element concerned, but which allows the threaded pin projections of the structural elements to be screwed into the threaded bores of the junction balls.

SUMMARY OF THE INVENTION

This object is achieved by the fact that the cylindrical section of the pin element to be inserted into the front end recess of the rod-shaped structural elements is shaped to conform to a guide casing, which casing may be turned and locked in the recess for the pin element. The pin element is configured to be non-rotatable, but axially displaceable in the guide casing in opposition to the action of a spring.

Thanks to such an arrangement, the threaded projection of the pin element can be forced into the guide casing against the reaction of a spring so that the structural element may be inserted into its position between two junction balls. Thus, the length of the rod-shaped structural element effectively complies with the spacing between the junction balls. Thereafter, pressure of the spring forces the threaded projection of the pin element to move against the threaded bore of the junction ball, and the pin element itself may be screwed into the threaded bore of the junction ball by turning the guide casing, within which it is radially immovable and therefore capable of being turned together with said guide casing.

In a further aspect of the invention, the guide casing consists of two partial casings radially severed one from another. The pin element is provided with a multi-corner shape section as well as a cylindrical section linked therein, in addition to the section which can be inserted into the junction ball and which has a male thread. The pin element is also provided with a collar end guided in one of the partial casings. A spring engages the front end of the collar end. This partial casing may be inserted into the front end recesses of the rod-shaped structural elements. The multi-corner shape section is preferable guided in the other partial casing which is provided with a corresponding multi-corner shape guide recess. Both partial casings are moved together with the rod-shaped structural element upon screwing the pin element into the junction ball, and are moved against the junction ball as in the case of the known configuration of the junction piece. In this manner the front end of the partial casing which faces the junction ball will lie firmly against its circumference.

The junction piece provides special advantage if the partial casings are turnably connected together. For example, one of the partial casings is provided with an annular projection capable of being inserted into a central threaded bore of the other partial casing. The turning junction may consist, as is known, of a lockwasher set ino one of the radial annular slots. It will then be possible to turn the partial casing which surrounds the multi-corner shape section of the pin element, this partial casing projecting from the front end recesses of the rod-shaped structural elements. The diameter of this partial casing may thereby be equal to the diameter of the rod-shaped element concerned. Recesses or supporting surfaces, respectively, can be provided on the circumference of this partial casing for tools intended to initiate the rotary motion. The front end facing the junction ball of the guide casing and the guide casing itself may show a concave recess in conformity with the ball section of the junction ball. It will then also be possible to have the circumference of the partial casings be of truncated conical form in axial direction away from the other partial casing for joining several rod ends to a ball of relatively small diameter.

BRIEF DESCRIPTION OF THE DRAWINGS

More details of the invention may be seen from the following description of the embodiment as shown in the accompanying drawing in which:

FIG. 1 illustrates a junction piece in axial section, and

FIG. 2 shows another embodiment of the junction piece in axial section as well.

DESCRIPTION OF THE PREFERRED EMBODIMENT

As can be seen from FIG. 1, the guide casing consists of partial casings 1 and 2. Both partial casings 1 and 2 are rotatingly linked together at their front ends facing each other. The partial casing 1 is provided with an annular projection 1*a* which is inserted into a central borehole 2*a* of the other partial casing. Borehole 2*a* and annular projection 1*a* have radial annular slots with a lockwasher 3 provided therein. The pin element 4, which is guided in both partial casings 1 and 2, exhibits a section 4*a* of male thread, a multi-corner shape section 4*b* and a cylindrical section 4*c* with a collar end 4*d*. The pin element 4 is guided along wih the multi-corner shape section 4*b* in the central recess 1*b* of the partial casing 1. The cross-section of the recess complies with the multi-corner sh ape. Pin element 4 together with its cylindrical section 4*c* is guided in the partial casing 2 which has a cylindrical recess 2*c*. The collar end 4*d* of the pin element 4 is moved in a recess 2*c* of the partial casing 2 relatively larger diameter and is engaged by a spring 5 urged strongly against a bottom cover 6 brought into the front end of the partial casing 2. Moreover, the partial casing 1 is provided with slots 1*f* on its circumference for a socket wrench. Diameter $D_B$ of the partial casing 1 complies with the O.D. $D_S$ of the rod-like structural element 7, of which the front end recess houses the partial casing 2. The front end of the partial casing 1 away from the casing 2 exhibits a concave recess 1*g* which conforms to the ball section of the junction ball K.

The rod-shaped structural element 7 and the partial casing 2 are linked together to be axially immovable through annular reinforcing rims of the structural element 7 forced into the annular grooves 2*k* of the partial casing 2. Instead of a junction system of this type, threaded bores which are to receive fastening screws can, as is known from DE-OS No. 2420864, also be provided in the rod-shaped structural element. The front end of the screws may be moved against the lateral walls of the annular grooves 2*k* located on the circumference of the partial casing.

The rod-shaped structural element 7, along with the pin element which is forced into the partial casing 1 in the direction of arrow against the action of the spring 5, is brought into its predetermined position in front of the junction ball K. In consequence of the action of the spring 5, the male thread section 4*a* of the pin element 4 is forced against the respective threaded bore of the junction ball K and screwed into the latter through the rotation of the partial casing 1. As soon as, during this operation, the corresponding ball section of the ball K has come into contact with the inside wall of the concave recess 1*g* of the partial casing 1, the pin element 4 draws both casings 1 and 2 together radially against the circumference of the junction ball K. This is because the annular rim of the collar 4*d* lies tightly against the annular section 2 of the central threaded bore 2*d* of the partial casing 2 at that point.

Considering the configuration as shown in FIG. 2, the circumference U of the partial casing 1′ proceeds in a truncated conical form in axial direction away from the other partial casing 2, thus diminishing the diameter of the concave recess 1*g*′ at the front end of the partial casing 1′. Such a configuration allows a structural element 7 whose longitudinal axis proceeds at an acute angle to be linked to the junction ball K.

What is claimed is:

1. A junction piece for releasable connecting rod-shaped tubular structural elements comprising:
   (1) a junction ball having threaded bores,
   (2) a pin element having
      a. a threaded end, the threads corresponding to those of the bores for insertion and fastening therein
      b. a multi-corner shaped section,
      c. a circular cylindrical section, and
      d. an enlarged diameter collar end,
   (3) a guide casing guiding the pin element and comprising
      a. first partial casing having a recess with cross-section corresponding in shape to the multi-corner shaped section of the pin element,
      b. a second partial casing with an outside diameter less than the inside diameter of the tubular structural member and fixed in the structural member, the second partial casing rotatably and coaxially connected relative with the first partial casing, the second partial casing having: a first recess of a cross-section corresponding to the circular cylindrical section of the pin element, and a second recess with cross-section corresponding to the enlarged-diameter collar of the pin element, and a bottom cover,
   (4) a compressible spring extending between the collar end of the pin element and the bottom cover of the second recess of the second partial casing.

2. A junction pieces as recited in claim 1, wherein the first partial casing has a annular projection which can be inserted into a central borehead of the second partial casing, the projection and the borehole each provided with annular slots for the insertion of a lockwasher to provide a rotatable junction.

3. A junction piece as recited in claim 1, wherein the first partial casing projects from the tubular rod shaped structural element.

4. A junction piece as recited in claim 3, wherein the outside diameter of the first partial casing is equal to the outside diameter of the rod shaped structural element.

5. A junction piece as recited in claim 1, wherein the first partial casing is provided with supporting faces for tools to initiate rotary motion of the first partial casing.

6. A junction piece as recited in claim 1, wherein the end of the first partial casing facing the junction ball is provided with a concave recess whose curvature corresponds to the curvature of the junction ball.

7. A junction pieces as recited in claim 1, wherein the first partial casing is of truncated conical form in axial direction away from the second partial casing and toward the junction ball.

* * * * *